US005592761A

United States Patent [19]

Ward

[11] Patent Number: 5,592,761

[45] Date of Patent: Jan. 14, 1997

[54] BACKHOE SCARIFYING APPARATUS

[76] Inventor: Arthur A. Ward, 17232 Anne Freda St., Canyon Country, Calif. 91351

[21] Appl. No.: 511,925

[22] Filed: Aug. 7, 1995

[51] Int. Cl.[6] ..... E02F 3/96

[52] U.S. Cl. ..... 37/403; 37/409

[58] Field of Search ..... 37/403, 404, 405, 37/406, 407, 408, 409, 410, 468; 171/63, 19; 299/126, 110, 39.8, 39.4, 79.1

[56] References Cited

U.S. PATENT DOCUMENTS

| | | | |
|---|---|---|---|
| 3,595,411 | 7/1971 | Ables | 37/403 X |
| 3,779,408 | 12/1973 | Ivie | 37/403 X |
| 4,023,288 | 5/1977 | Roe | 37/403 |
| 4,100,688 | 7/1978 | Grist | 37/403 |
| 4,113,023 | 9/1978 | Baskett | 171/63 |
| 4,278,368 | 7/1981 | Livesay | 37/405 X |
| 4,490,070 | 12/1984 | Upchurch et al. | 37/403 X |
| 4,698,926 | 10/1987 | Caplis et al. | 37/403 |
| 4,793,732 | 12/1988 | Jordon | 37/403 X |
| 4,803,789 | 2/1989 | Hackmack | 37/403 |
| 4,852,276 | 8/1989 | Savoca et al. | 36/136 |
| 5,060,732 | 10/1991 | Baskett | 37/405 X |
| 5,388,893 | 2/1995 | Maxwell et al. | 37/403 X |
| 5,423,137 | 6/1995 | Cochran | 37/403 X |
| 5,478,139 | 12/1995 | Scott | 37/403 X |

OTHER PUBLICATIONS

Agricultural Implement Bearings, Fafnir Textron, pp. 29,30, 32,40,94.

*Primary Examiner*—Dave W. Arola
*Assistant Examiner*—Victor Batson
*Attorney, Agent, or Firm*—Roger A. Marrs

[57] ABSTRACT

A scarifying assembly mounted in a backhoe bucket is disclosed herein having a toothed roller operably carried between spaced-apart support arms which include bearings and a chain or geared drive coupled to a hydraulic power source. The attachments for assembling the opposite ends of the roller include splined fittings which revolve with the roller. Both the roller and splined fittings have outwardly projecting teeth angularly disposed with respect to each other and to the peripheral surface of the roller and the fittings. The roller attachments, fittings and hydraulic power source provide a readily convenient arrangement for rapid assembly or disassembly for service, maintenance and repair procedures. A wedge structure is carried on the power source having a terminating edge in close proximity to the projecting teeth for the purpose of breaking-up or fragmenting rocks carried between the teeth.

5 Claims, 2 Drawing Sheets

FIG. 1.
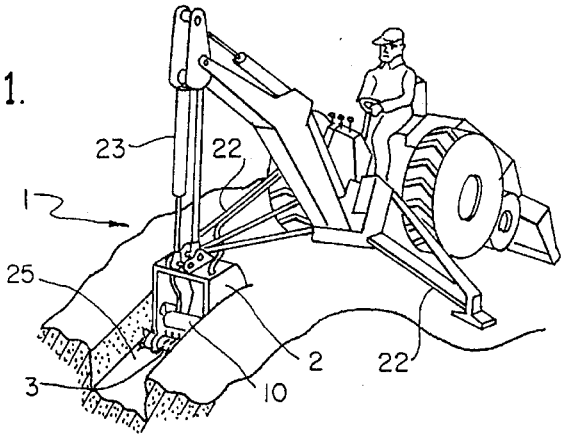
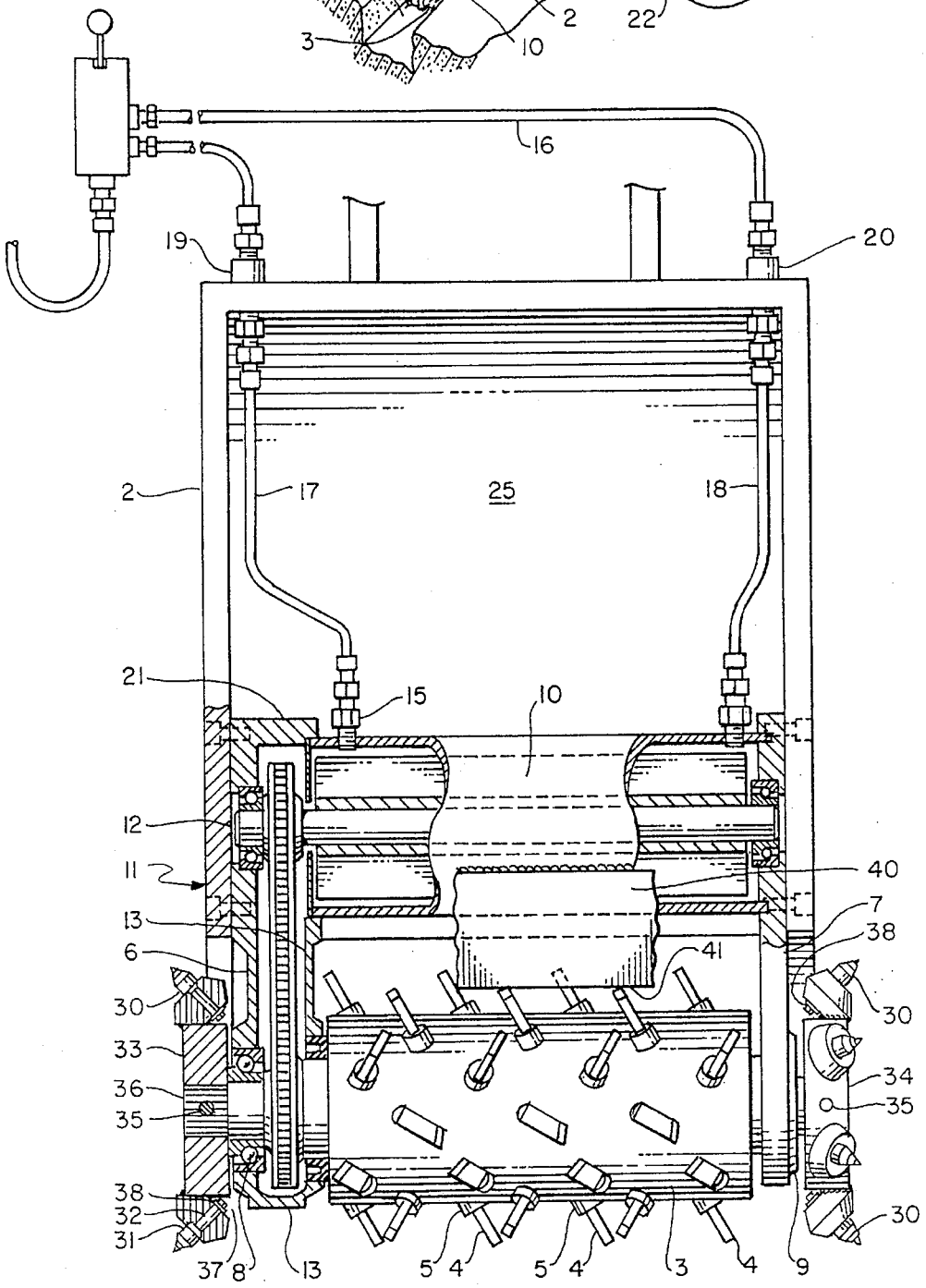
FIG. 2.

BACKHOE SCARIFYING APPARATUS

BACKGROUND OF THE INVENTION

1. Field of the Invention

The present invention relates to the field of scarifying apparatus used to break up soil and to dig earth trenches, and more particularly to a novel scarifying assembly having toothed roller mounting and supporting means providing improved load-carrying capabilities and disassembly characteristics over conventional apparatus.

2. Brief Description of the Prior Art

During building construction and landscaping, the need arises to lay underground pipelines and conduits. The trenches are frequently long and can be as deep as required. During the trenching, several different soil compositions can be encountered, including hardpan strata which a regular backhoe bucket is unable to break up and will simply slide over. Similarly, while contouring a land area for utility trenches or other purposes, the composition of the soil can go from loose soil to hardpan, resulting in high and low areas. Larger tractor equipment can overcome this difference in soil composition but is not practical from a cost aspect, or if the area is limited in size.

Attempts have been made to provide scarifying apparatus such as that disclosed in U.S. Pat. No. 4,852,276, which have been successful; however, problems have been encountered in the area of service, repair and maintenance which stem largely from difficulties encountered in removing pre-assembled components, access to such components and providing adequate distribution of applied load forces.

Therefore, a long-standing need has existed to provide a scarifying apparatus wherein the major components are readily accessible and wherein improved assembly and construction practices provide greater load-carrying characteristics as well as earth digging or scarifying results. Means are needed to split or break rocks that may be jammed between adjacent teeth as the toothed roller revolves during a digging procedure.

SUMMARY OF THE INVENTION

Accordingly, the above problems and difficulties associated with trenching multi-composition soil and the use of large tractors in confined areas can be overcome by the novel backhoe scarifier apparatus of the present invention. A scarifying roller is mounted in a backhoe bucket in parallel alignment with a bucket scraping edge that is operated by hydraulic pressure. The roller is attached to supporting bearings at each end and is covered with a plurality of radially extending replaceable cutting surfaces around its circumference. Attached to one end of the roller is a drive mechanism which is coupled to a hydraulic motor mounted in the bucket. The hydraulic motor is fluid coupled for connecting into a hydraulic power system of the tractor. The drive mechanism is covered by a detachable protective shield. Rotation of the roller, assisted when necessary with the downward pressure provided by the backhoe hydraulic piston assembly and the partial weight of the tractor, results in the scarifying of a uniform width trench.

A feature of the invention resides in detachably mounting a plurality of scarifier teeth in angular relationship to each other about the peripheral surface of the roller and its mounting fittings. The fittings are in splined relationship with respect to the opposite ends of the roller and separated from the roller ends by a pair of support members. The hydraulic motor and drive mechanism are carried on the support member so that a unitary construction results whereby the toothed roller and the motor with its drive mechanisms may be assembled with or disassembled from the bucket as a unit or component structure.

Therefore, it is the primary object of the present invention to provide a backhoe tractor bucket for scarifying trenches in a construction excavation utilizing the hydraulic system of the backhoe tractor system.

Still another object of the present invention is to provide a novel scarifier where the scarifying teeth can be replaced as they wear or as the composition of the soil varies.

Another object resides in providing a novel scarifying apparatus having its toothed roller, motor and drive mechanism mounted as a unitary component for convenient assembly or disassembly for installation, service or maintenance purposes.

A further object resides in providing a plurality of teeth in angular outwardly projecting relationship so as to carry applied load forces to structural elements of the apparatus.

Yet a further object resides in removably mounting the toothed roller on support members via bearing with the employment of splined collars or fittings providing greater load-carrying and distributing capabilities.

An important feature of the invention resides in providing a rock-breaking means such as a wedge shaped plate immediately ahead of a line of teeth on a roller capable of engaging and fragmenting the rocks caught between adjacent teeth during a digging procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings.:

A more complete understanding of the invention may be had by referring to the following detailed description taken in conjunction with the drawings herein.

FIG. 1 is a pictorial view of the backhoe scarifier of the present invention mounted on a backhoe tractor.

FIG. 2 is a front perspective view of the backhoe scarifier.

DESCRIPTION OF THE PREFERRED EMBODIMENT

Referring to FIG. 1, a backhoe scarifier 1 is illustrated incorporating the present invention which includes a backhoe bucket 2 as having an open cavity facing forward; however, the cavity may open facing rearward towards the driver as desired.

Figure 3:
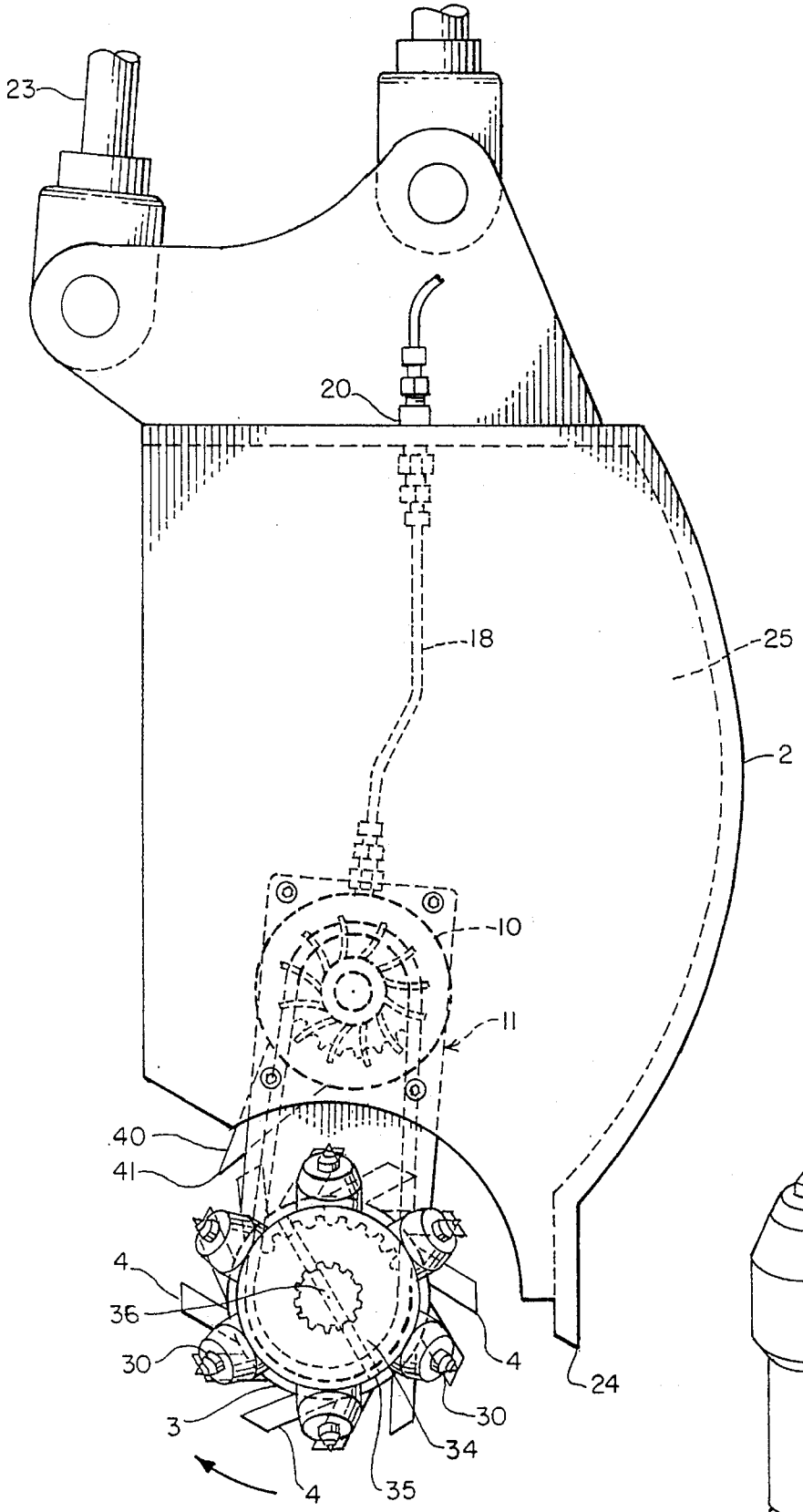
FIG. 3 is a side view of the backhoe scarifier of FIG. 2.

Referring now to FIGS. 1, 2 and 3, the backhoe scarifying apparatus 1 includes a cylindrical roller 3 connected to the backhoe bucket 2 by means of roller axially mounted bearings 8 and 9 which mount to the backhoe bucket 2 at attachment arms 6 and 7. The attachment arms 6 and 7 are thick steel plates which are attached to the sides of the backhoe bucket and serve as a mounting surface for the roller axially mounted bearings 8 and 9. Extending radially from the roller 3 are a plurality of steel cutting teeth 4 which are attached to the roller 3 by means of holding devices 5 which allow individual tooth replacement due to wear or breakage. The roller 3 has a turning axis parallel to a scraping edge 24 of the bucket extending between parallel sides defining a storage cavity.

Roller 3 has an axially mounted motor drive 10 which connects to a drive mechanism 11 that connects to a motor drive coupling 12. The motor drive mechanism can consist of two chain sprockets and a drive chain or a series of universal joints and drive shafts. The entire drive mechanism is covered by a protective cover 13 which prevents debris from interfering with the drive mechanism operation.

The motor drive coupling 12 is attached to the hydraulic motor 10 which is mounted to the backhoe bucket by a bracket 21 in the area. The hydraulic motor 10 has a hydraulic high pressure coupling 15 which attaches to a hydraulic hose 17 that terminates in a hydraulic coupling 19 directly connected into the tractor hydraulic high pressure system. The hydraulic motor has a hydraulic return pressure coupling 16 which attaches to a hydraulic hose 18 which terminates in a hydraulic coupling 20 which connects to the tractor hydraulic return system.

In a preferred embodiment of the present invention, the cylindrical roller 3 is a solid steel bar which will not distort when the holding devices 5 are welded to the roller. The holding devices 5 can accept various width cutting teeth 4 made of carbide steel or other materials heat-treated to achieve any desired hardness. The axially mounted bearings 8 and 9 are pressed bearing construction which slide over the ends of the roller 3. The bearings are a pressed fit on side plates 6 and 7. Attachment plates 6 and 7 are 1 inch thick in order that no deterioration occurs during bearing installation and that the bearings are fully supported. The attachment arms 6 and 7 are attached to the sides of the backhoe bucket by bolts; the attachment plates' alignment in the backhoe bucket results in the cylinder roller 3 being located near the cutting edge 24 of the backhoe bucket in parallel spaced-apart relationship.

The motor drive coupling is slid axially over cylindrical roller 3 and is a pressed fit to the roller. The motor drive coupling consists of a gear whose teeth will engage the links of the drive mechanism and which is attached to the hydraulic motor central shaft.

The hydraulic motor 10 is a commercially available drive motor which is mounted to a bracket to the backhoe bucket. The drive motor has a high pressure input port which accepts the high pressure coupling 15. The high pressure coupling has an integral hydraulic hose which terminates in a quick release hydraulic coupling 19 which attaches to the backhoe tractor hydraulic system. The drive motor has a hydraulic pressure return port which accepts the hydraulic return pressure coupling 16. The hydraulic return pressure coupling has an integral hydraulic hose which terminates in a quick release hydraulic coupling 20 which connects to the backhoe tractor hydraulic return system.

Figure 4:
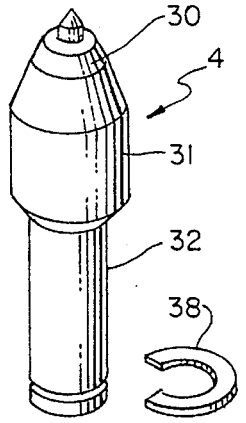
FIG. 4 is an enlarged perspective view of a tooth as employed in the apparatus of FIGS. 2 and 3.

Referring now in detail to FIGS. 2, 3 and 4, it can be seen that the tooth 4 includes a ground engaging portion 30 which outwardly projects from a base 31 from which a shank downwardly depends, as identified by numeral 32. The shank is intended to engage with a conformal bore or opening in end pieces 33 and 34 respectively, located on opposite ends of the drive shaft outwardly projecting from the opposite ends of the roller 3. The shank connection of the tooth is shown more clearly in FIG. 2 in connection with end piece 33. It is also to be noted that the end piece 33 as well as end piece 34 are connected to the ends of the outwardly projecting shaft of roller 3 by means of a radial splined arrangement 36. A key pin 35 is included to ensure proper fastening of the end pieces to the splined end of the shaft. The end pieces 33 and 34 include recesses, such as recess 37, into which a portion of the shank 32 projects and the tooth is secured by means of a snaplock ring 38 which partially occupies each of the respective cavities 37. Because of the shank arrangement, the teeth carried on the outer end pieces 33 and 34 can rotate. It is also to be particularly noted that the outwardly projecting teeth are at an angle with respect to the flat surface of the roller and that the teeth, including the teeth carried on the end piece, are not parallel with respect to each other in adjacent rows. Therefore, it may be said that the teeth are angularly disposed with respect to their mounting surfaces.

FIG. 1 shows the backhoe scarifier in the scarifying position. The backhoe tractor is placed in position to begin scarifying a trench. The scoop bucket is lowered and the outriggers 22 are used to balance the tractor. The thrust piston 23 is extended to apply downward pressure on the scarifier as the cylindrical roller 3 begins scraping. The soil which is broken loose due to the cutting action of the scarifying teeth 4 and the pressure applied by the thrust piston 23 and the weight of the tractor is projected into the backhoe bucket until it is full. Scarifying is then terminated and the full bucket is off loaded to the side of the trench.

It is understood from the foregoing description that the scarifier of the present invention provides several important benefits over a simple backhoe tractor bucket system. Using the cutting capabilities of the described apparatus, which can include carbide tool cutting teeth, soil and any encountered rocks or hardpan caliche or frozen ground can be broken up. Presently, these types of soil are encountered and the backhoe bucket is unable to break thee materials loose, larger equipment is required for further trenching. Larger equipment results in an immediate cost increase and might not even be usable if the work area is limited in size. The only other solution has been to bring in manual labor to break up the rock or hardpan. The cost in time and labor is clear. The present invention allows a single operator with the access capabilities of a backhoe tractor to complete the required trenching. Further, while landscape grading, hardpan is frequently encountered and a regular backhoe tractor bucket will skip over the hardened area. The present invention enables the backhoe operator to scarify the hard soil into the desired contour.

Although FIG. 1 shows the revolving ground preparing elements or pins 3 and the backhoe cavity facing forward, this is illustrated for clarity and ease of illustration. The cavity, as indicated by number 25, may face rearwardly towards the boom and driver/operator of the apparatus. This latter orientation would be more in keeping a backhoe digging procedure.

However, it is important to note that the revolving ground preparing elements, such as blades 4, may take the form of removable conical pins. The elements 4 break up the ground immediately ahead of the bucket ledge 24 so that the scarifier can load the broken up soil directly into the cavity 25 of the bucket. The elements are powered so that hard ground is readily broken up into. Soil during a clarifying procedure so that the edge 24 immediately follows to pick up the soil for deposit into the cavity 25.

It is to particularly noted that not only can the individual tooth 4 be readily replaced after wear, but the teeth 30 attached to the end pieces 33 and 34 may be readily changed by removing the lock pin 38 and pulling the teeth outward from its splined connection. Thus, maintenance and repair is greatly simplified. Maintenance and repair is further augmented by the user of retaining pin 35 which holds the respective end pieces onto the ends of the shaft of roller 3. Once the retaining pin has been removed, the end pieces may be easily extracted from their splined coupling. Then the roller can be readily disassembled using ordinary procedures.

The splined connection of the end pieces with the end of the shaft greatly assists repair and maintenance procedures. It is understood that tremendous loads are encountered by the teeth during the scarifying procedure. Also be enclosing or housing the drive mechanism, including the chain and bearings, dirt and debris is kept out of the mechanism and the device has longer life. By employing the mounting arms 21, the roller, including the mounting teeth, extends beyond the lip of the bucket, identified by numeral 24 in FIG. 3. This positioning ensures that the breaking up of soil will occur immediately ahead of the bucket lip so that the broken up soil can be readily collected within the cavity 25 of the bucket.

A novel feature is illustrated in FIGS. 2 and 3 which shows a wedge plate 40 having a terminating edge 41 immediately adjacent, but in spaced relationship, to a row of teeth. As the roller 3 revolves, rocks oftentimes become lodged between adjacent teeth during the digging procedure. The nearest row of teeth to the plate will cause any lodged rocks to engage with the edge 41. The forced engagement results in crushing and fragmenting of the rocks with debris falling into the bucket 25.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a backhoe tractor for dislodging of and collection of soil during a trench excavation procedure, including a hydraulic power system and a hydraulically actuated boom assembly mounted on said backhoe tractor, the improvement which comprises the combination:

a bucket pivotally connected to said boom assembly having a terminating edge between opposite sides leading into a storage cavity for gathering and receiving hard ground;

an elongated cylindrical roller rotatably carried on said bucket opposite sides parallel to and facing said terminating edge of said bucket in fixed spaced relationship and having a plurality of outwardly and radially projecting elements arranged in staggered rows and columns from said roller in close proximity to said terminating edge;

each of said elements is characterized as being replaceable and deployed about the circumference of said roller;

motor means carried on said bucket for driving said roller and including means of connection to said hydraulic power system of the backhoe tractor;

said rotatable roller disposed with respect to said bucket storage cavity for reception and collection of dislodged soil;

said elements outwardly projecting at an angle with respect to said roller;

said roller having end portions outwardly projecting from opposite ends of said roller;

said end portions having splines;

end pieces having splined bores matable with said splined end portions to retain said roller on said bucket;

a plurality of teeth means carried on each end piece;

smooth shank and bore means matably supporting said teeth means on said end pieces; and a lock ring releasably retaining each of said teeth means on said end piece.

2. The invention as defined in claim 1 wherein:

each teeth means includes a tooth carried on an elongated shank terminating in a notched end;

said notched end adapted to snap-lock with said lock ring; and said lock ring having a larger outside diameter than the diameter of said shank.

3. The invention as defined in claim 2 including:

tooth holders carried on said roller and said end pieces respectively in welded relationship; and said tooth of said teeth means rotatably carried in each of said welded tooth holders.

4. The invention as defined in claim 3 including:

a rock crushing plate secured to, said motor means having a linear terminating edge in close proximity to said elements and in spaced-apart relationship thereto.

5. The invention as defined in claim 4 wherein:

said rock crushing plate is of wedge shape in cross-section and extends across the length of said roller.

* * * * *